US007090039B2

(12) United States Patent
Van Wijk

(10) Patent No.: US 7,090,039 B2
(45) Date of Patent: Aug. 15, 2006

(54) ASSEMBLY FOR DRILLING LOW PRESSURE FORMATION

(75) Inventor: Johannes Van Wijk, Assen (NL)

(73) Assignee: Shell Oil Company, Houston, TX (US)

( * ) Notice: Subject to any disclaimer, the term of this patent is extended or adjusted under 35 U.S.C. 154(b) by 191 days.

(21) Appl. No.: 10/488,730

(22) PCT Filed: Sep. 6, 2002

(86) PCT No.: PCT/EP02/10039

§ 371 (c)(1),
(2), (4) Date: Mar. 24, 2004

(87) PCT Pub. No.: WO03/023182

PCT Pub. Date: Mar. 20, 2003

(65) Prior Publication Data

US 2005/0006148 A1 Jan. 13, 2005

(30) Foreign Application Priority Data

Sep. 7, 2001 (EP) ..... 01307594

(51) Int. Cl.
*E21B 21/08* (2006.01)

(52) U.S. Cl. ..... 175/393; 175/57; 175/324

(58) Field of Classification Search ..... 175/57, 175/65, 393, 339, 324, 213, 217
See application file for complete search history.

(56) References Cited

U.S. PATENT DOCUMENTS

| | | | | |
|---|---|---|---|---|
| 2,946,565 | A * | 7/1960 | Williams | 166/264 |
| 4,137,975 | A | 2/1979 | Pennock | |
| 4,630,691 | A | 12/1986 | Hooper | |
| 4,744,426 | A | 5/1988 | Reed | |
| 4,898,244 | A | 2/1990 | Schneider et al. | |
| 6,209,663 | B1 * | 4/2001 | Hosie | 175/57 |
| 6,877,571 | B1 * | 4/2005 | Hughes et al. | 175/57 |
| 6,957,698 | B1 * | 10/2005 | Krueger et al. | 166/116 |
| 2002/0170749 | A1 * | 11/2002 | Hoyer et al. | 175/25 |

FOREIGN PATENT DOCUMENTS

WO 02/14649 2/2002

* cited by examiner

*Primary Examiner*—David Bagnell
*Assistant Examiner*—Daniel P. Stephenson

(57) ABSTRACT

The invention relates to a drilling assembly for drilling a borehole into geological formations which assembly comprises:

a drilling shaft placable in the borehole, which shaft has a drilling head; and a pump device placable in the borehole, wherein the pump device has sealing means for sealing a first borehole part below the sealing means from a second borehole part above the sealing means, and wherein the pump device is enabled to pump a fluid from the first borehole part to the second borehole part.

25 Claims, 4 Drawing Sheets

ASSEMBLY FOR DRILLING LOW PRESSURE FORMATION

PRIORITY CLAIM

The present application claims priority on European Patent Application 01307594.0 filed on 7 Sep. 2001.

FIELD OF THE INVENTION

The invention relates to a drilling assembly for drilling a borehole into geological formations, comprising a drilling shaft placable in the borehole, which shaft comprises a drilling head.

BACKGROUND OF THE INVENTION

Holes are drilled onshore and off-shore for getting access to oil fields and gas fields. These fields are located underground in one of the geological layers.

When drilling a borehole a drilling fluid is used to transport cuttings out of the borehole. With borehole depths of some hundreds of meters up to some kilometres the hydrostatic pressure at the bottom of the borehole could be some hundreds of bars.

Because of these high hydrostatic pressures, the drilling fluid has the tendency to penetrate the geological formations. When entering the formation layer, in which the energy source, such as oil or gas, is located, the drilling fluid could penetrate this layer through which this layer gets clogged and the production of gas or oil is affected. This problem arises especially with low pressure fields.

It is known to adjust the density of the drilling fluid in order to adjust the hydrostatic pressure at the bottom of the borehole. However this hydrostatic pressure variation generally does not correspond to the pressure variation in the specific formation layer. Especially when trilling a borehole in a low pressure field, the maximum pressure of this field could be substantially lower than the hydrostatic pressure of the drilling fluid.

SUMMARY OF THE INVENTION

It is an object of the invention to provide a drilling assembly which enables a better control over the hydrostatic pressure of the drilling fluid in the zone of the formation in which the energy source is present.

This object is achieved by a drilling assembly for drilling a borehole into geological formations, which assembly comprises:

- a drilling shaft placable in the borehole, which shaft comprises a drilling head; and
- a pump device placable in the borehole, wherein the pump device comprises sealing means for sealing a first borehole part below the sealing means from a second borehole part above the sealing means, and wherein the pump device is enabled to pump a fluid from the first borehole part to the second borehole part.

The pump device eliminates the hydrostatic pressure caused by the fluid column above the pump device. So the only hydrostatic pressure present at the bottom of the drilled borehole is caused by the fluid column between the bottom of the borehole and the pump device. This enables one to vary the pressure at the bottom of the borehole between the hydrostatic pressure caused by the fluid column between the bottom and the pump device and the hydrostatic pressure of the total fluid column in the borehole.

Preferably the drilling assembly further comprising a substantially tube shaped casing placable in the borehole, and wherein the sealing means includes a first sealing for sealing the pump device on the casing inner wall and a second sealing for sealing the pump device on the drilling shaft, such that in longitudinal direction the first borehole part is sealed off from the second borehole part.

In a preferred embodiment the drilling assembly according to the invention comprises near one end of the casing a valve for closing said one end of the casing.

The valve is helpful for closing off the bottom part of the borehole when the pump device is removed from the borehole in order to install for example a casing into the newly drilled part of the borehole. In a preferred embodiment of the invention, the pump device is rotatably arranged on the drilling shaft. The drilling shaft provides in this way a guide for the pump device and makes it easy to seal the pump device on the drilling shaft, when the drilling shaft is rotated in order to deepen borehole. Preferably the drilling shaft comprises a slick drilling string. This has the advantage that with this assembly a borehole can be deepened over a substantial length. Conventional drilling strings comprise thickenings, which limit the stroke, which the drilling string of the assembly according to the invention can make through the pump device.

In another preferred embodiment the pump device is drivable by a driving fluid. This is preferably the drilling fluid. As the borehole is already filled with drilling fluid, this can be used to drive the pump device. Only a supply channel has to be arranged to supply the fluid to the pump and the discharge pipe is formed by the already drilled borehole. It is also possible to drive the pump with an electric motor.

In another embodiment of the drilling assembly according to the invention an opening is arranged in the casing wall to which the pump device is connectable. In this embodiment the supply channel for the driving fluid is formed by the space between the casing and the surface of the borehole. The driving fluids can be pumped through this space and through the opening in order to drive the pump device.

In yet another embodiment the pump is reversible in order to pump the fluid above the first sealing away, preferably via the annulus formed by the casing of the assembly and the already drilled borehole.

The invention also relates to a method for drilling a borehole into geological formations, which method comprises the steps of:

- arranging a drilling shaft in the borehole, which shaft comprises a drilling head;
- arranging a pump device in the borehole, wherein the pump device comprises sealing means for sealing a first borehole part below the sealing means from a second borehole part above the sealing means;
- operating the pump device so as to pump a fluid from the first borehole part to the second borehole part; and
- driving the drill shaft to deepen the borehole.

The sealing is done such, that the drill string can still extend pass this sealing means. The sealing means is used to separate the bottom part of the borehole from the upper part of the borehole. This in order to enable the pump to create a pressure difference between the two parts.

To remove the drilling shaft from the borehole, suitably the following steps are included:

- lifting the drilling shaft to a position in which the drill head is located underneath and adjacent the sealing means;

pumping away at least a part of the fluid present above the sealing means;

opening the sealing means; and removing the drilling shaft from the borehole.

Preferably said sealing means is a primary sealing means, and the method of removal of the drilling shaft further comprises:

arranging a secondary sealing means in the borehole below the drilling head.

To remove or replace the drill string suitably the method further comprises:

lowering the drilling shaft into the borehole to a position in which the drill head is located between the primary and secondary sealing means;

closing the primary sealing means;

pumping fluid from underneath the primary sealing means to above the primary sealing means; and opening the secondary sealing means.

According to the invention a secondary sealing means is provided which divides the bottom part of the borehole in two sections. This secondary sealing means can be embodied as a valve. It creates a lock chamber through which the drilling head can be removed from the lower borehole part and be transferred to the upper borehole part, while keeping the low hydrostatic pressure at the bottom of the borehole.

When the pump device is again in place in the casing, the lock chamber can be depressurized by pumping the fluid to the upper part of the borehole. This makes it possible to open the second sealing and to bring the drilling head to the bottom of the borehole to deepen the borehole further. This method can also be used to transport a casing through the bottom part of the borehole, after which installation it is not necessary to maintain the low pressure at the bottom of the borehole, as the casing prevents penetration into the formation layer.

BRIEF DESCRIPTION OF THE DRAWINGS

These and other features and advantages of the present invention are described in more detail in the following in combination with the drawings.

DETAILED DESCRIPTION OF THE PREFERRED EMBODIMENT

Figure 1:
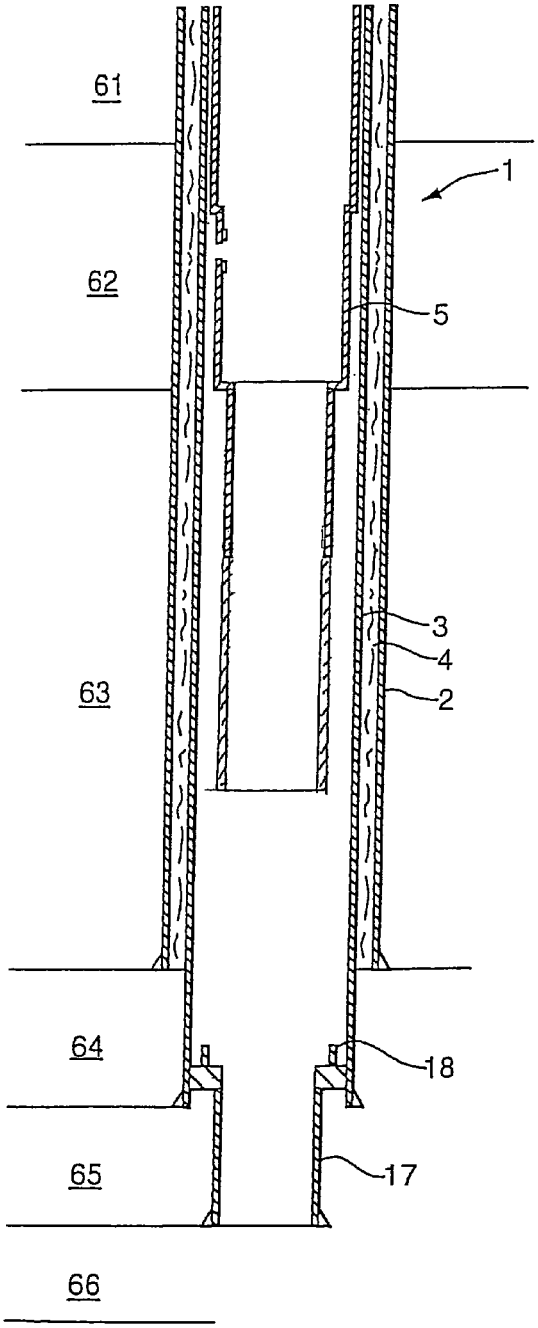
FIG. 1 shows a different step in the drilling of a process

In FIG. 1 a tube shaped casing 5 of a first embodiment of a drilling assembly 1 according to the invention is placed into an already drilled borehole, which is lined by three casings 2, 3, 17. The space between the two casings 2, 3 is filled with concrete 4.

The three casings 2, 3, 17 penetrate a number of geological formations 61–65. In order to deepen the borehole into the geological formation 66, which contains the energy source, such as gas or oil, the drilling assembly 1 is used.

Figure 2:
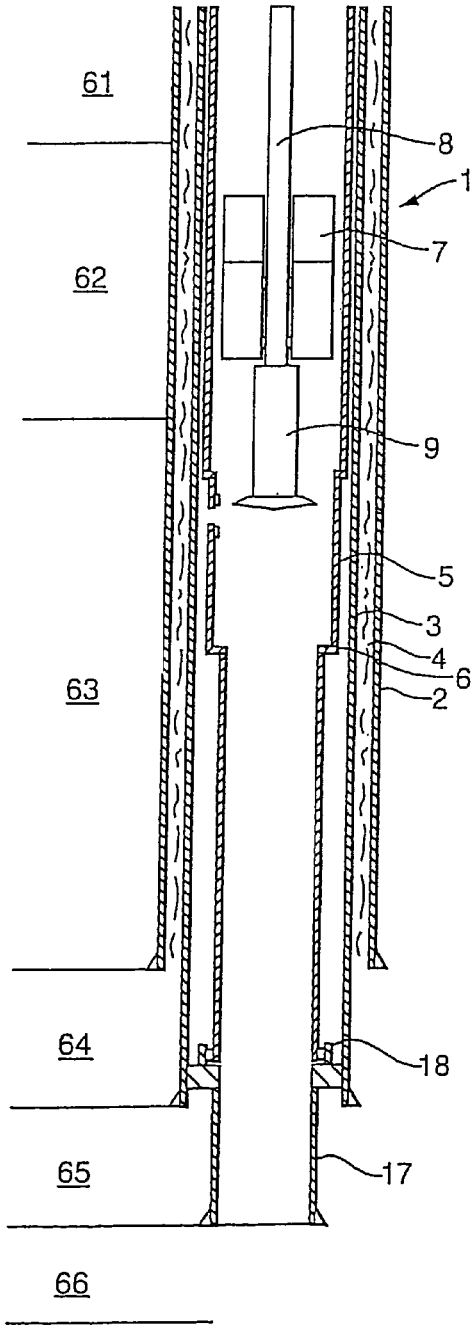
FIG. 2 shows a different step in the drilling of a process

After the casing 5 is landed into the so-called Polish Bore Receptacle 18, a slick drill string 8 on to which a pump device 7 is brought into the casing 5 (see FIG. 2). The inner wall of the casing 5 is stepped to provide a shoulder 6 on which a pump device 7 is supported.

Figure 3:
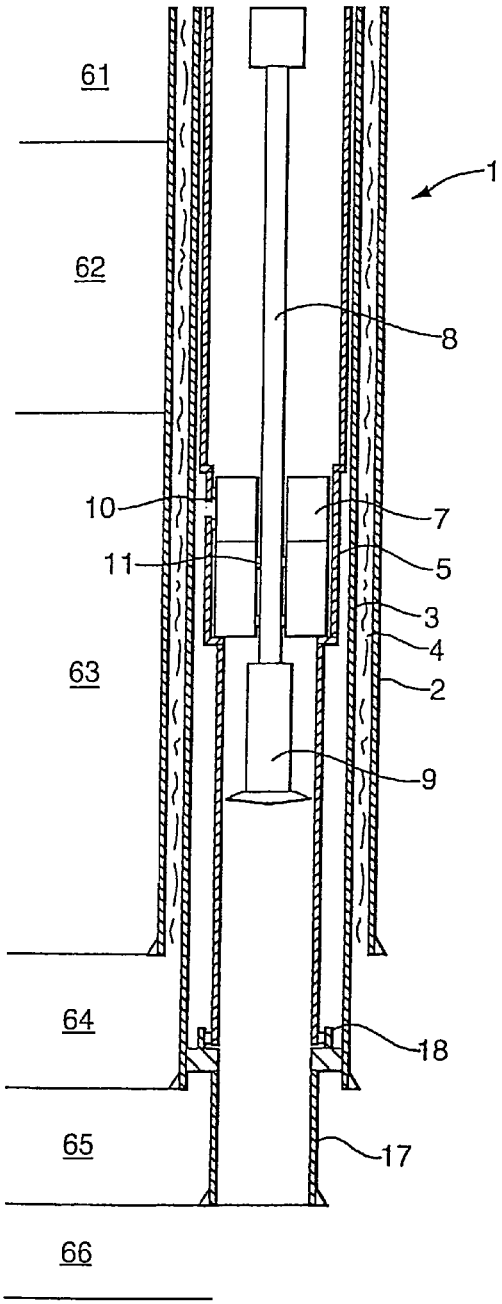
FIG. 3 shows a different step in the drilling of a process

A slick drill string 8 extends through this pump device 7. At the bottom end of this slick drill string 8 a drilling head 9 is arranged (see FIG. 3).

The pump device 7 is sealed on the casing 5 by a first sealing 10 and the pump device 7 is sealed on the slick drilling string 8 by a second sealing 11.

Figure 4:
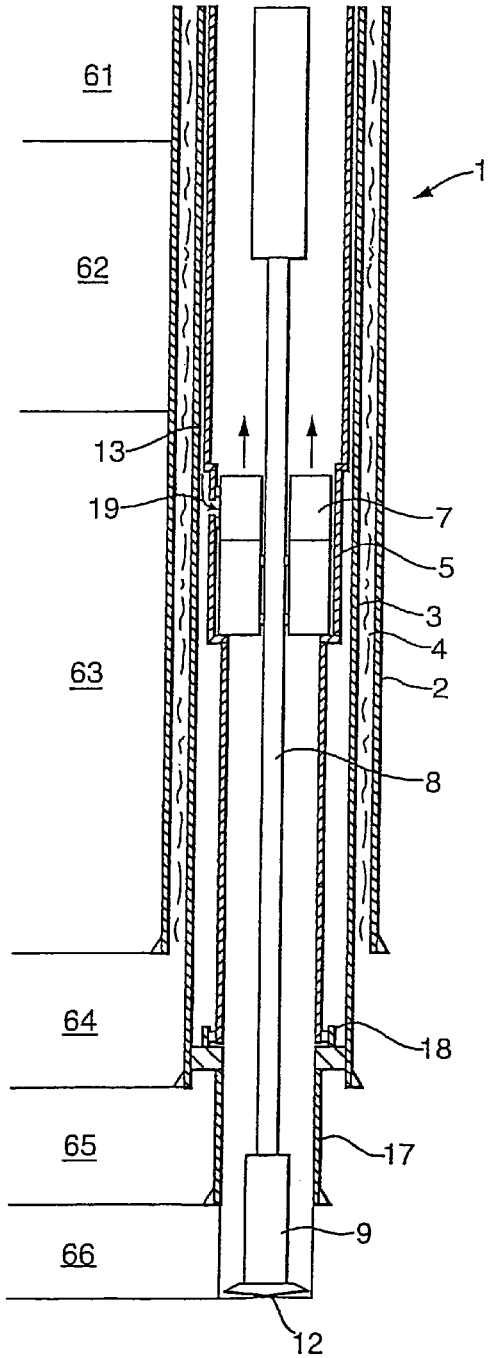
FIG. 4 shows a different step in the drilling of a process

For deepening the borehole, the drill string 8 with the drilling head 9 is lowered to the bottom 12 of the borehole (see FIG. 4).

When deepening the borehole a part of this newly drilled part does not yet have a casing. In order to prevent drilling fluid penetrating the geological formation 66, the pump device 7 reduces the hydrostatic pressure of the drilling fluid column present in the drilling borehole. The hydrostatic pressure can be limited by the pump device 7 to a pressure equal to the drilling fluid column extending from the bottom 12 to the pump device 7. So the pressure caused by the drilling fluid column above the pump device 7 is eliminated. The pump device 7 could be an electric pump or could be driven by a driving fluid 19, which is pumped through a channel 13 which is present in the annulus formed between the casing 5 of the drilling assembly 1 and the already installed casing 2.

Figure 5:
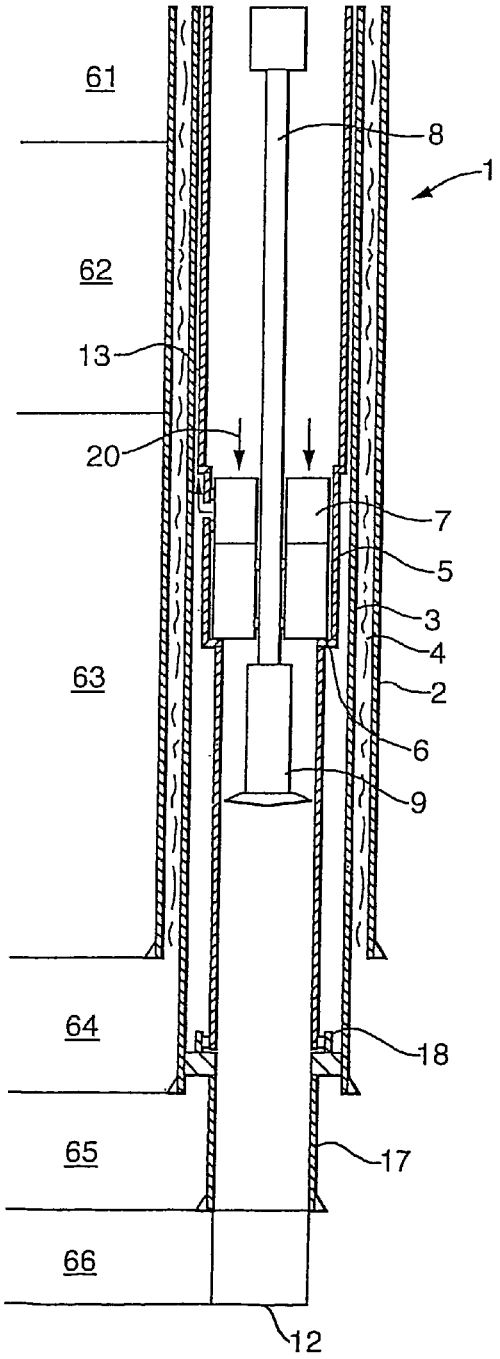
FIG. 5 shows a different step in the drilling of a process

Now referring to FIG. 5, when the drill string 8 has to be removed from the borehole, the pumping action of the pump 7 is reversed, such that drilling fluid 20 present above the pump is pumped away via the annulus 13 out of the borehole. When enough drilling fluid has been pumped away, i.e. the hydrostatic pressure of the full drilling fluid column substantially equals the pressure present in the formation 66, the pump 7 and drill string 8 can be removed from the borehole.

Figure 6:
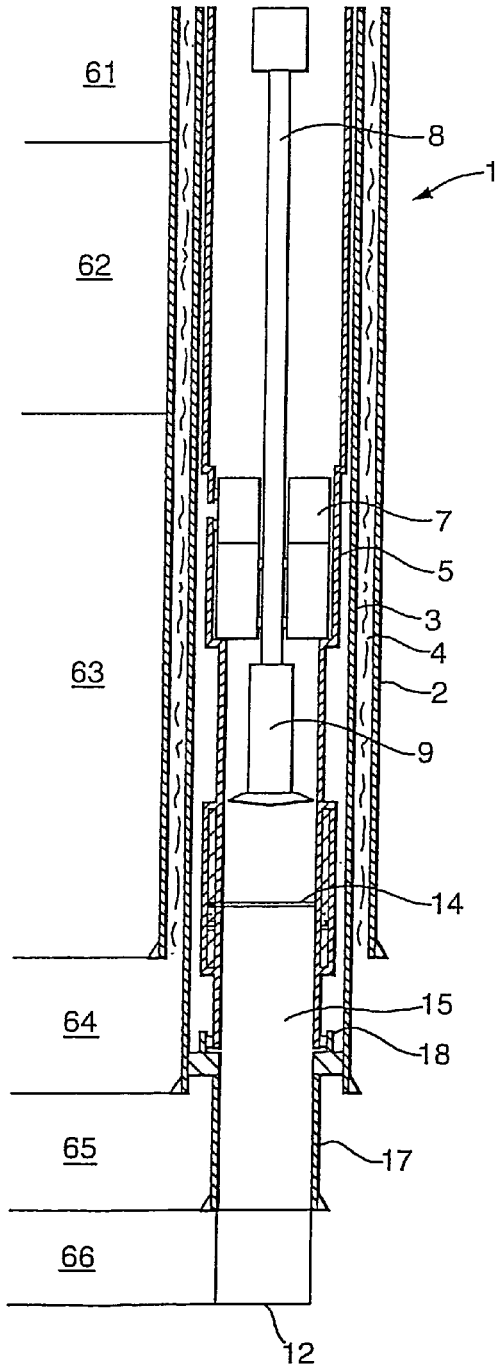
FIG. 6 shows a different step in the removal of a second embodiment in the drilling process

Referring to FIG. 6, a second embodiment of a drilling assembly according to the invention further comprises a valve 14. The remaining construction of the assembly is similar to the assembly according to FIG. 1–5. Similar components are designated with the same reference signs as in FIGS. 1–5.

This valve 14, which is arranged in the casing 5 of the drilling assembly, is used to shut off the bottom part 15 of the drilled borehole. In some circumstances it is because of safety regulations necessary that the borehole is fully filled with drilling fluid, for example in case the geological layer 66 contains very poisonous gasses, such as $H_2S$.

When removing the pump device 7, this valve 14 prevents that the hydrostatic pressure in the bottom part of the borehole 15 increases to a pressure equal to a fluid column with the height of the full borehole.

Figure 7:
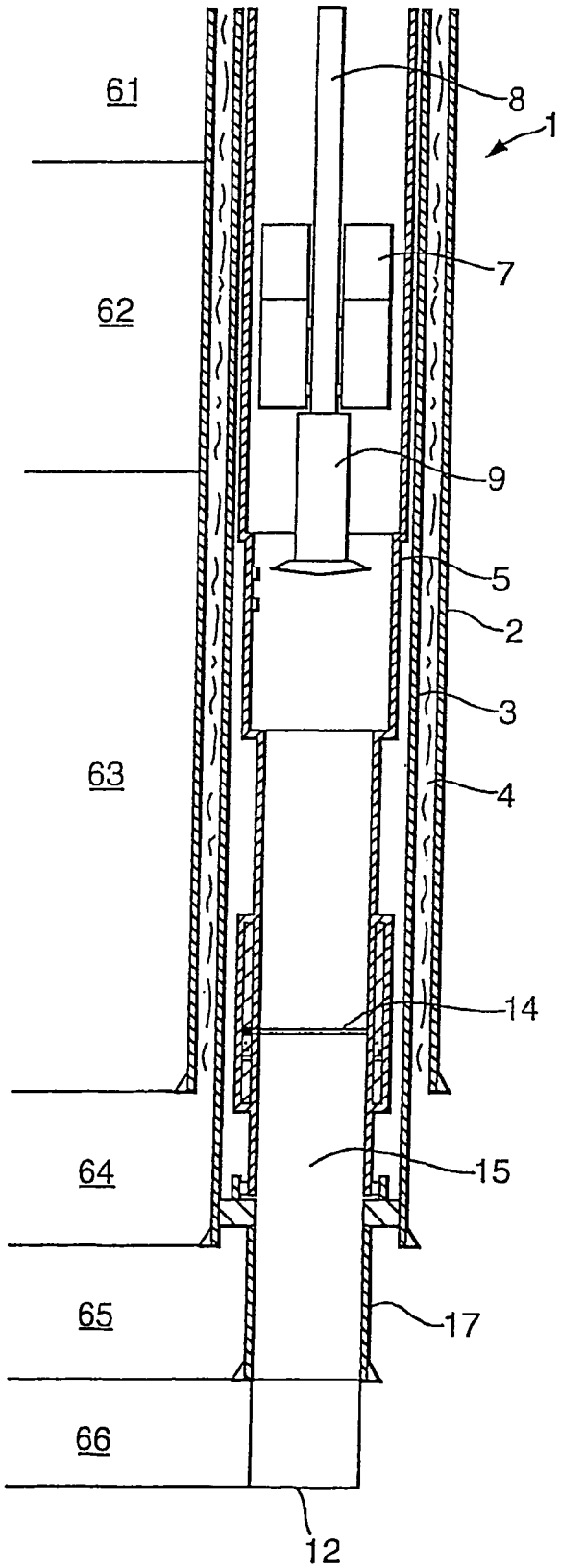
FIG. 7 shows a different step in the removal of a second embodiment in the drilling process

With this valve 14 shut, the drill string 8 together with the pump device 7 can be removed from the borehole for example in order to exchange the drilling head 9 (see also FIG. 7).

When reintroducing a new drilling head or for example a liner for the newly drilled part of the borehole, the pump device 7 is again supported by the shoulders 6. The pump device 7 is then driven to reduce the hydrostatic pressure, after which the valve 14 van be opened and the new drill head or liner can be introduced in the bottom part of the borehole 15.

It should be noted that the figures are not drawn to scale. A typical drilling assembly according to the invention can be several hundreds of meters.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claim be limited to the examples and descriptions set forth herein but rather that the claims be construed as encompassing all features which would be treated as equivalents thereof by those skilled in the art to which this invention pertains.

The invention claimed is:

1. A drilling assembly for drilling a borehole into geological formations, said assembly comprising a drilling shaft placable in the borehole, which shaft comprises a drilling head and a pump device wherein the pump device comprises sealing means for sealing a first borehole part below the sealing means from a second borehole part above the sealing means, and wherein the pump device is enabled to pump a fluid from the first borehole part to the second borehole part, and wherein the drilling head is lowerable in the borehole relative to the pump device.

2. The drilling assembly of claim 1, further comprising a substantially tube shaped casing placable in the borehole, and wherein the sealing means includes a first sealing for sealing the pump device on the casing inner wall and a second sealing for sealing the pump device on the drilling shaft, such that in longitudinal direction the first borehole part is sealed off from the second borehole part.

3. The drilling assembly of claim 2, wherein said casing comprises near one end of the casing a valve for closing said one end of the casing.

4. The drilling assembly of claim 2, wherein an opening is arranged in the casing wall to which the pump device is connectable.

5. The drilling assembly of claim 4, wherein an annular space is defined between the casing and the borehole in which the casing is placed.

6. The drilling assembly of claim 5, wherein said annular space is defined between the casing and another casing fixedly arranged in the borehole.

7. The drilling assembly of claim 5, wherein means is provided for feeding a driving fluid through said annular space to the opening in the casing wall in order to drive the pump device.

8. The drilling assembly of claim 2, wherein the substantially tube shaped casing comprises a shoulder on which the pump device can be supported.

9. The drilling assembly of claim 1, wherein the drilling shaft extends through the pump device, and the drilling shaft is rotatably arranged relative to the pump device.

10. The drilling assembly of claim 1, wherein the drilling shaft comprises a slick drilling string.

11. The drilling assembly of claim 1, wherein the pump device is drivable by a driving fluid or an electric motor.

12. The drilling assembly of claim 1, wherein the pump device is retrievable from the borehole.

13. The drilling assembly of claim 12, wherein the pump device is suspended by the drilling shaft during retrieving of the pump device from the borehole.

14. The drilling assembly of claim 1, wherein the pump device is suspended by the drilling shaft during placing of the pump device in the borehole.

15. The drilling assembly of claim 1, wherein the pump device is reversible.

16. A method of drilling a borehole into geological formations said method comprising the following steps:

arranging a drilling shaft comprising a drilling head and a pump device in the borehole, the pump device comprising sealing means for sealing a first borehole part below the sealing means from a second borehole part above the sealing means in the borehole;

using the sealing means to separate the first borehole part from the second borehole part;

operating the pump device so as to pump a fluid from the first borehole part to the second borehole part; and lowering the drill head relative to the pump device and driving the drill shaft to deepen the borehole.

17. The method of claim 16, further comprising:

lifting the drilling shaft to a position in which the drill head is located underneath and adjacent the sealing means;

pumping away at least a part of the fluid present above the sealing means;

opening the sealing means; and removing the drilling shaft from the borehole.

18. The method of claim 17, wherein said sealing means is a primary sealing means, the method further comprising:

arranging a secondary sealing means in the borehole below the drilling head.

19. The method of claim 18, further comprising:

lowering the drilling shaft into the borehole to a position in which the drill head is located between the primary and secondary sealing means;

closing the primary sealing means;

pumping fluid from underneath the primary sealing means to above the primary sealing means; and opening the secondary sealing means.

20. A method of drilling a borehole into geological formations said method comprising the following steps:

arranging a drilling shaft comprising a drilling head in the borehole;

arranging a pump device comprising sealing means for sealing a first borehole part below the sealing means from a second borehole part above the sealing means in the borehole;

using the sealing means to separate the first borehole part from the second borehole part;

operating the pump device so as to pump a fluid from the first borehole part to the second borehole part;

lowering the drill head relative to the pump device;

driving the drill shaft to deepen the borehole;

lifting the drilling shaft to a position in which the drill head is located underneath and adjacent the sealing means;

pumping away at least a part of the fluid present above the sealing means;

opening the sealing means; and removing the drilling shaft from the borehole.

21. The method of claim 20, wherein said sealing means is a primary sealing means, the method further comprising:

arranging a secondary sealing means in the borehole below the drilling head;

lowering the drilling shaft into the borehole to a position in which the drill head is located between the primary and secondary sealing means;

closing the primary sealing means;

pumping fluid from underneath the primary sealing means to above the primary sealing means; and opening the secondary sealing means.

22. A drilling assembly for drilling a borehole into geological formations, said assembly comprising:

a drilling shaft placable in the borehole, which shaft comprises a drilling head;

a substantially tube shaped casing placable in the borehole;

a pump device placable in the borehole, wherein the pump device comprises sealing means for sealing a first borehole part below the sealing means from a second borehole part above the sealing means, and wherein the pump device is enabled to pump a fluid from the first borehole part to the second borehole part, and wherein the sealing means includes a first sealing for sealing the pump device on the casing inner wall and a second sealing for sealing the pump device on the drilling shaft, such that in longitudinal direction the first borehole part is sealed off from the second borehole part, wherein the drilling head is lowerable in the borehole relative to the pump device, and wherein an opening is arranged in the casing wall to which the pump device is connectable.

23. The drilling assembly of claim 22, wherein an annular space is defined between the casing and the borehole in which the casing is placed.

24. The drilling assembly of claim 23, wherein said annular space is defined between the casing and another casing fixedly arranged in the borehole.

25. The drilling assembly of claim 23, wherein means is provided for feeding a driving fluid through said annular space to the opening in the casing wall in order to drive the pump device.

* * * * *